US005620345A

United States Patent [19]

Macioce et al.

[11] Patent Number: 5,620,345

[45] Date of Patent: Apr. 15, 1997

[54] HIGH DENSITY PIN AND SOCKET ELECTRICAL CONNECTOR

[76] Inventors: Lawrence Macioce, 150 Hidden Hills Dr., Kernersville, N.C. 27284; Peter G. Nielsen, 144 Whispering Creek Rd., King, N.C. 27021

[21] Appl. No.: 618,656

[22] Filed: Mar. 19, 1996

Related U.S. Application Data

[60] Continuation of Ser. No. 599,468, Jan. 23, 1996, which is a division of Ser. No. 327,258, Oct. 21, 1994, abandoned.

[51] Int. Cl.[6] ..... H01R 13/428

[52] U.S. Cl. ..... 439/746

[58] Field of Search ..... 439/746–749

[56] References Cited

U.S. PATENT DOCUMENTS

| | | | |
|---|---|---|---|
| 2,290,172 | 7/1942 | Eby | 439/747 |
| 3,588,789 | 6/1971 | Kailus | 439/748 |
| 4,462,654 | 7/1984 | Aiello | 339/91 R |
| 4,479,691 | 10/1984 | Smith, Jr. | 339/59 M |
| 4,544,220 | 10/1985 | Aiello et al. | 339/59 M |
| 4,681,363 | 7/1987 | Fukishima et al. | 439/851 |
| 4,900,271 | 2/1990 | Colleran et al. | 439/595 |
| 4,943,248 | 7/1990 | Colleran et al. | 439/849 |
| 4,979,913 | 12/1990 | Aiello et al. | 439/596 |
| 5,035,658 | 7/1991 | Berg | 439/748 |
| 5,078,618 | 1/1992 | Peloza | 439/439 |
| 5,108,304 | 4/1992 | Bogiel et al. | 439/290 |
| 5,131,873 | 7/1992 | Gierut et al. | 439/851 |
| 5,145,422 | 9/1992 | Fry | 439/856 |
| 5,167,544 | 12/1992 | Brinkman et al. | 439/856 |
| 5,190,478 | 3/1993 | Colleran et al. | 439/595 |

*Primary Examiner*—Gary F. Paumen

[57] ABSTRACT

A pin and socket connector assembly includes a stamped and formed pin terminal 2 and a stamped and formed socket terminal 4 received respectively in cavities of a cap housing 6 and a matable plug housing 8. Both the pin and socket terminals have rigid retention ribs 20, 40 located on stabilization sections 12 and 32 which cause the cylindrical stabilization sections to accurately inwardly deform as the terminals are inserted into the housing with the retention ribs engaging internal housing shoulders to lock the terminals in place. The socket terminal 2 has a socket terminal of generally triangular configuration with a seam formed by the terminal edges locate on one side and a slot 50 stamped at the apex of the other sides of the terminal extending partially into the socket section. Rigid embossed dimples 54 are located on the interior of the socket section to form fixed contact points for engaging a mating pin terminal.

13 Claims, 8 Drawing Sheets

HIGH DENSITY PIN AND SOCKET ELECTRICAL CONNECTOR

This application is a Continuation of Ser. No. 08/599,468 filed Jan. 23, 1996 which is a Divisional of application Ser. No. 08/327,258 filed Oct. 21, 1994, now abandoned.

BACKGROUND OF THE INVENTION

1. Field of the Invention

The subject matter of this invention is an electrical connector and a contact terminals used in that connector. The terminals are stamped and formed pin and socket terminals having defined contact points and lanceless contact retention sections. The connector housings are multiposition soft shell housings with keyed engagement.

2. Description of the Prior Art

Stamped and formed pin and socket electrical contact terminals mounted in multiposition soft shell housings are widely used for connecting electrical harnesses in a wide variety of applications. These soft shell pin and socket connectors are used in electrical appliances, automobiles, computers as well as similar applications. These prior art connectors are generally inexpensive to manufacture and use conventional materials such as brass or phosphor bronze for the contact terminals and conventional plastics such as Nylon for the insulation housing.

The most common form of these connectors use lanced contact terminals on both the stamped and formed female sockets and male pins which are crimped to the end of an insulated wire from which the insulation has been removed at the end of the wire. These terminals can be attached to wires using automated connector application machines. These lanced contact terminals typically have a stabilization section for centrally positioning the terminals in a single terminal cavity in the housing. This stabilization section is generally cylindrical and are normally located next to the wire crimp section of the terminal near the rear of the terminal.

Lanced stamped and formed pin and socket terminals typically have one or more lances formed outwardly from the generally cylindrical profile of the terminals between the stabilization section and the contact section of the terminals. These lances, which are in the form of a cantilever beam with one end joined to the terminal, extend at an acute angle with the ends of the lances facing the rear of the terminal. These ends of these lances extend outwardly beyond the inner dimension of the housing cavities in which the pin or socket contact section resides. When the pin or socket terminal is inserted into a housing cavity from the rear, the lances are inwardly deflected. When a terminal is fully inserted into its cavity, the lances will be located in a larger section of the cavity and the lances can spring back essentially to their normal position. A shoulder will generally be formed at the intersection of a larger cavity portion, in which the contact pin or socket portion of the terminal normally resides and the smaller portion of the cavity in which the crimp and stabilization sections of the terminals normally are located. The lances engage this shoulder to prevent withdrawal or back out of the terminal. A larger section of the terminal adjacent the rear of the terminals normally prevents the terminal from being inserted further into the cavity. The engagement between the lances and the housing shoulder provides the primary reaction surface against which a force is applied when pin and socket connectors are mated. These lances also prevent removal of the terminals prior to mating is a force is applied to the wires to which the terminals are attached. Since these connectors are typically applied on a mass production basis, reliable retention of the contact terminals in the housing is a important part of providing a quality assembly.

Although these traditional lanced pin and socket connectors continue to satisfactorily a wide variety of applications, there are problems associated with lanced pin and socket terminals. Although the terminals are stamped from resilient metals, the protruding lances can be overstressed, in which case they will not return to their normal position when released. Since the lances are exposed prior to insertion into the housing, this type of damage to the lances will occasionally occur. Since these terminals are used in large quantities, this type of damage is difficult to detect. These terminals are also used in connectors having multiple cavities, and one damaged terminal can result in a rejection of a larger connection. For example, sixteen position connectors are common and the percentage of defective connectors will be sixteen times the percentage of defective contact terminals.

Another problem with traditional lanced pin and socket terminals arises which these connectors are used in applications in which terminals at applied to a plurality of wires in a wiring harness. This is a typical use of pin and socket terminals in automotive and other applications. The wiring harness is assembled prior to insertion of the pin and socket terminals into the connector housing. The exposed lances on these terminals can easily snag the wires in the harness causing the harness to become entangled. The harnesses must then be disentangled adding an otherwise unnecessary manufacturing rework operation and thus adding cost to the assembly of the product in which the pin and socket terminal is used.

One solution to the some of the problems faced with lanced pin and socket terminals and connectors is the use of lanceless pin and socket terminals. Conventional lanceless pin and socket terminals have a small diameter or necked down section of the terminal between the pin or socket contact portion of the terminals and the terminal stabilization section of the terminal adjacent the rear of the terminals. A resilient plastic latch can be molded in the housing cavity. This plastic latch exhibits a resilient cantilever configuration and protrudes into the housing cavity. The latch deflects out of the way when the terminal is inserted and returns to its normal position when the smaller necked down section of the terminal is positioned next to the latch. The plastic latch then engages a shoulder formed on the pin or socket terminal to prevent withdrawal of the terminal. These lanceless pin and socket connectors have also met with considerable success and they quite satisfactorily meet the requirements of many applications. There are however certain problems associated with lanceless pin a socket connectors. Since the plastic latches must be resilient, the choice of material for the connector housing will be limited by this requirement. Thus the connectors may not be as inexpensive as they might otherwise be or they may not be able to satisfactorily meet the requirements of applications used in more stringent environments. Perhaps more importantly the presence of the latches in the housing results in a more expensive molded plastic housing. Additional material is required and the molds have more elaborate core pins for forming the housing cavities and therefore become more expensive to make and more expensive to operate. Additional cost is added to the final product. These plastic latches also can limit the size of the pin and socket connector which can effectively use lanceless pin and socket terminals. Smaller center to center distances for the terminals ultimately become unattainable with a lanceless terminal.

In some cases the contact retention attainable with both traditional lanced and conventional lanceless pin and socket terminals is unsatisfactory for a specific applications. In these cases a secondary lock is typically employed. These secondary locks typically engage some portion of the connector housing to provide additional backup for the terminals. Some secondary locks engage both the connector housing and the contact terminals. For example a secondary lock can be attached to the rear of the connector housing and can have a surface overlapping the rear of the terminal to prevent withdrawal. Some secondary locks also engage the resilient plastic latches to hold them in engagement with the lanceless pin or socket terminals. One form of this type of secondary lock can be inserted from the front of the housing between the end of the plastic latch and an adjacent surface of the housing. Some secondary locks are in the form of separate pieces which can be attached to the connector after assembly. These secondary locks can be attached to the rear or to the front, and in some cases are inserted into the housing from the side to prevent contact withdrawal. However, secondary locks in the form of distinct pieces can be lost or improperly assembled, and in any event constitute a separate part which must be inventoried and a separate manufacturing operation which add cost to the final product. Some secondary locks can be integral parts of the connector house and are typically are joined to the housing by a flexible web. At least one prior art connector employs a secondary lock of this type located at the rear of the main housing body. In some applications even secondary locking is not alone sufficient. Some assurance that the terminal is properly seated is required. This terminal position assurance is sometimes provided by a secondary lock with cannot be properly seated unless the terminals are properly positioned.

One objection, sometimes expressed in regard to any of these pin and socket terminals and connectors is that the cylindrical barrel shaped configuration of the typical pin as socket contact section does not provide a defined repeatable contact point for terminal to terminal engagement. Some concern has been expressed about the integrity of the contact interface for conventional pin and socket terminals. Reliable contact insertion forces have similarly been questioned. One alternative to the pin and socket terminal which is sometimes employed is a flat blade and socket configuration in which cantilever contact arms are used in the socket. A precise contact interface can be achieved by the engagement of these cantilever contact arms with the flat blade. However, these conventional blade and receptacle terminals can be inserted into an insulative housing in only one orientation. Again this complicates assembly of the connector and adds cost to the product.

Proper orientation of mating connectors is also important so that the connectors can only be mated in one orientation, thus insuring that only corresponding lines will be mated in multiposition electrical connectors. One conventional approach to the problem is to use slightly different cross sectional shapes for the housing cavities and housing silos in mating connectors. Some silos and cavities may have a circular cross section while others could have a square cross section and still others could have rounded corners, sometime having a generally D-shaped cross section. These different cross sections must be sufficiently different so that the soft shell housings cannot be deformed when excessive mating force is applied. Although this approach is generally reliable, one problem is that this approach requires the use of multiple core pins in the molds for each different cavity. A common cross section would permit the use of common core pins and the manufacture of many different housings with different numbers of contacts would be less expensive.

SUMMARY OF THE INVENTION

This subject matter of this invention includes a stamped and formed socket terminal in which the socket section of the terminal has a generally triangular section with a seam formed by the edges of the stamped and formed terminal forming a seam along one side of the socket section. A stamped slot extends from the front of the socket section for a portion of its length. This slot is located at the apex of the other two sides of the triangular socket section. Rigid embossed dimples are formed on the inside of each of the three sides of the socket section. These dimples form fixed contact points for engaging a pin inserted into the socket. Since these pins are a fixed distance from the root of the slot the deflection of the socket will be known and the contact and mating forces will be predictable. The sockets and the circular pins which they engage can be inserted into the housing in any orientation.

The socket terminal and its mating stamped and formed pin terminal also have a stabilization section adjacent the contact sections. This stabilization section is generally cylindrical, but is formed so that the longitudinal edges of the stabilization section are spaced apart to form a gap. On both sides of this gap, a tapered embossed retention rib is outward formed. This retention rib is contiguous with the stabilization rib at the front and on each side with a rearwardly facing edge sheared. The retention rib is outwardly tapered toward the rear of the terminal so that the rearwardly facing sheared edge is at the maximum outer diameter. When the stabilization section is inserted through a smaller cavity section in the housing the tapered embossed rib causes the edges of the generally cylindrical stabilization section to be cammed inwardly and toward each other to cause the gap to be temporarily smaller. The stabilization expands when the retention rib clears this smaller cavity section and the rear sheared edge engages a cavity shoulder to prevent withdrawal of the terminal.

The housings in which these terminals can be inserted are trapezoidal in shape and keying surfaces in the form of companion keys and grooves in cavities and silos are formed at the wider base of the trapezoidal shape to insure that the connectors can be mated in only one orientation.

There are several important objects of this invention. As in most cases involving electrical connectors, a low cost product is important. A simple and easy to manufacture terminal and housing configuration is always important to minimizing the cost of an electrical connector.

Another object of this invention is to achieve a high density centerline spacing for the contact terminals. The primary embodiment of this invention has a 4 mm centerline spacing for adjacent contact terminals.

Another important object of this invention is the elimination of the problems encountered with lanced contacts by providing a terminal with housing engagement features which will not be overstressed or damaged prior to use and which will not become entangled with the wires in a harness.

Also important is achieving high electrical performance. The primary embodiment of this invention is intended for use in applications having a Underwriters Laboratory and Canadian Standards Association voltage rating of 600 volts. A current rating of 12 amps is also an object for this connector.

An additional object of this invention is a pin and socket connector having a high contact retention force with secondary locking and terminal position assurance.

Both low mating force and low contact insertion force are objects of this invention.

This invention is also intended to achieve the defined contact interface which is a feature of a flat blade and receptacle contact interface, but to achieve that defined contact interface in a pin and socket configuration so that the pin and socket terminals can be inserted into the connector housing in any orientation.

Other objects of this invention are to provide a keyed housing configuration which can only be assembled to a mating connector in one orientation to preserve the identity of specific lines in a multiposition connector and also to provide high housing latch strength and positive housing latch locking in a small connector. Mating connectors should not require visual observation during mating and should be suitable for use with high temperature materials. Printed circuit board configurations and hybrid systems with power and signal contact embodiments should also not be inconsistent with the terminal and housing designs.

DETAILED DESCRIPTION OF THE PREFERRED EMBODIMENT

Figure 1:
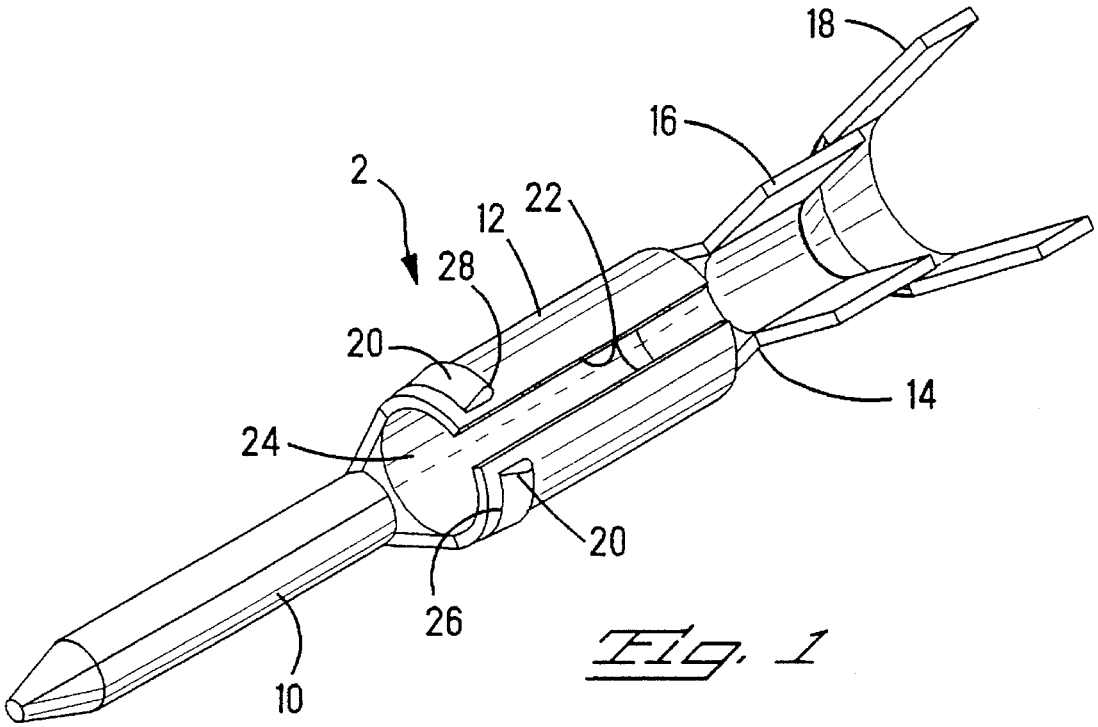
FIG. 1 is a perspective view of the preferred embodiment of a stamped and formed pin contact terminal.

The pin and socket connector comprising the preferred embodiment of this invention comprise a stamped and formed pin contact terminal 2, a stamped and formed pin socket terminal 4, a multiposition, multirow cap housing 6 and a multirow, multiposition plug housing 8. In use the pin contact terminal 2 is positioned in the cap housing 6 and the socket terminal 4 is positioned in the plug housing 8. Cap housing 6 is matable with plug housing 8 and the plurality of pin terminals 2 are intermatable with corresponding socket terminals 4 when the housings are mated.

The pin contact terminal 2 is stamped from flat spring metal stock and is formed into a generally cylindrical configuration. The terminal can be gold or tin plated in a conventional manner. Pin terminal 2 has a pin contact section 10 located at the forward end. This pin contact section is tapered or rounded at the forward end and the and has a long section having a generally circular cross section. The flat stamped blank used to form the pin terminal 2 is progressively formed so that the opposed edges abut to form a continuous seam in the pin contact section.

A stabilization section or barrel 12 is located to the rear of the pin contact section 10 and is joined to the pin contact section by a tapered section 24. The diameter of the stabilization section 12 is greater than the diameter of the pin section 10 and the edges 22 of the flat blank are spaced apart to form a gap instead of an abutting seam in the stabilization section. The tapered section 24 extends only partially around the circumference of the pin terminal 2. This tapered section 24 extends approximately 130 degrees around the circumference of the cylindrical pin terminal 2. The tapered section 24 is located on the opposite side of the terminal from the gap formed by the spaced apart edges 22 of the stabilization section.

A crimp section 14 of the pin terminal 2 adjoins the stabilization section 12 at the rear of the pin terminal. This crimp section includes a wire crimp section 16 and an insulation crimp section 18 at the rear end of the terminal. The wire crimp section 16 is of conventional construction and has two opposed crimping arms which are inwardly deformed by a crimping press to establish a metal to metal crimp connection with a bare wire section positioned between the opposed crimping arms. In the preferred embodiment of this invention, this crimp section 16 is suitable for terminating a #16 AWG wire. The insulation crimp section is also of conventional construction having two opposed arms which engage the insulation of a wire adjacent the bare, stripped end which is terminated. The insulation crimp is formed at the same time that the wire is crimped in a conventional manner. The insulation crimp provides a strain relief which limits the stresses which might otherwise be placed on the wire crimp. In the preferred embodiment of this invention the insulation crimp arms do extend outwardly from the wire insulation so that a relatively larger bearing surface is presented at the rear of the pin contact terminal 2. This larger bearing area will be engaged by the secondary lock on the cap housing 6 as will be subsequently described.

Two embossed areas 20 extend outwardly from stabilization section 12 adjacent the two edges 22 and at the front of the stabilization section. These embossed areas 20 are punched out from the flat blank stock during the progressive forming of the pin terminal 2. These embossed areas 20 are tapered from the base 26 adjacent the front of the stabilization section 12 toward the rear edge 28 of the tapered embossed areas 20. This rear edge 28 is a sheared edge and is separated from the metal forming the stabilization section 12. The embossed areas are however joined to the generally cylindrical section 22 along the sides extending between the front base 26 to the rear sheared edge 28. These embossed area are not the resiliently deformable cantilevered lances used on conventional lanced pin and socket terminals since the embossed areas are rigid and do not deform relative to the stabilization section 12 when a radially inwardly directed force is applied during insertion of the pin terminal 2 into cap housing 6. Embossed areas 20 do however comprise a tapered camming surface which engages an adjacent wall of the housing during insertion of the pin terminal 2. The inwardly directed forces are applied to the stabilization section 12 during terminal insertion. Since the edges 22 are spaced apart, this inwardly directed force applied through the relatively rigid tapered camming surfaces of embossed areas 20 to the stabilization section 12 causes the two parts of forming this section to inwardly flex to constrict and to bring the edges 22 closer together. Thus the outer dimension of the stabilization section is reduced when a force is applied thorough the tapered camming embossed areas 20 permitting the embossed areas to pass through a constricted section of the cap housing 6. When the terminal 2 is fully inserted, the stabilization section is free to flex outwardly to return to its unflexed condition. The rear edge 28 now faces a housing shoulder at its rear to prevent withdrawal of the pin terminal 2. The embossed area 20 and the rear edge 28 thus serve as a retention rib. The action of the terminal during insertion will be subsequently described in reference to the construction of the cap housing 6.

Figure 2:
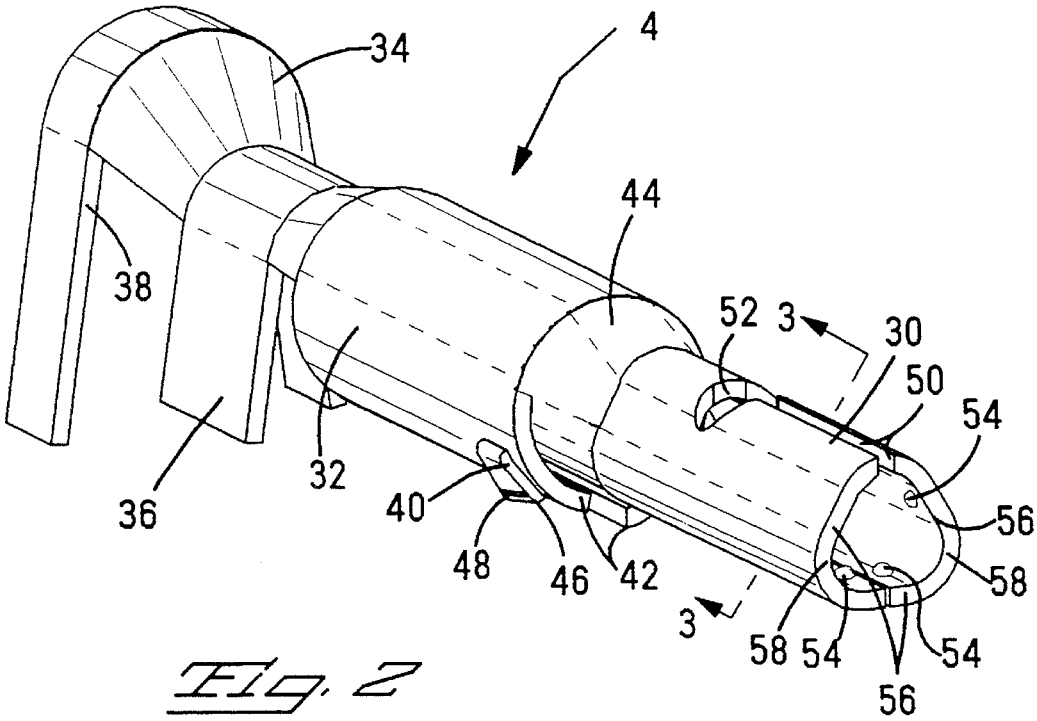
FIG. 2 is a perspective view of the preferred embodiment of a stamped and formed socket contact terminal suitable for mating with the pin terminal shown in FIG. 1.

The stamped and formed socket terminal 4 contains features similar to the pin terminal 2 which act in the same manner during insertion of the socket terminal 4 into a cavity in the plug housing 8. The socket contact section 30 is different and will be subsequently described in more detail. Socket contact action 30 located at the front of the socket terminal 4 is joined to the middle stabilization section 32 by the tapered section 44. As with the pin terminal 2, the stabilization section 32 has a larger outer dimension than the socket contact section 30. Tapered section 44 extends only partially around the circumference of the socket terminal 4 in the same manner as the tapered section 24 on pin terminal 2. The crimp section 34 is joined to the rear of the stabilization section 32 and includes a wire crimp 36 and an insulation crimp 38 which are the same as pin terminal wire crimp section 16 and insulation crimp section 18 respectively and perform in the same way. Embossed areas 40, only one of which is visible in FIG. 2, are located at the front of the stabilization section 32 adjacent spaced apart edges 42; Embossed areas 40 also comprise tapered retention ribs extending between a base 46 and a rear shared edge 48. The stabilization section 32 is identical to the stabilization section 12 on pin terminal 2 and performs the same functions in the previously describe way.

Figure 3:
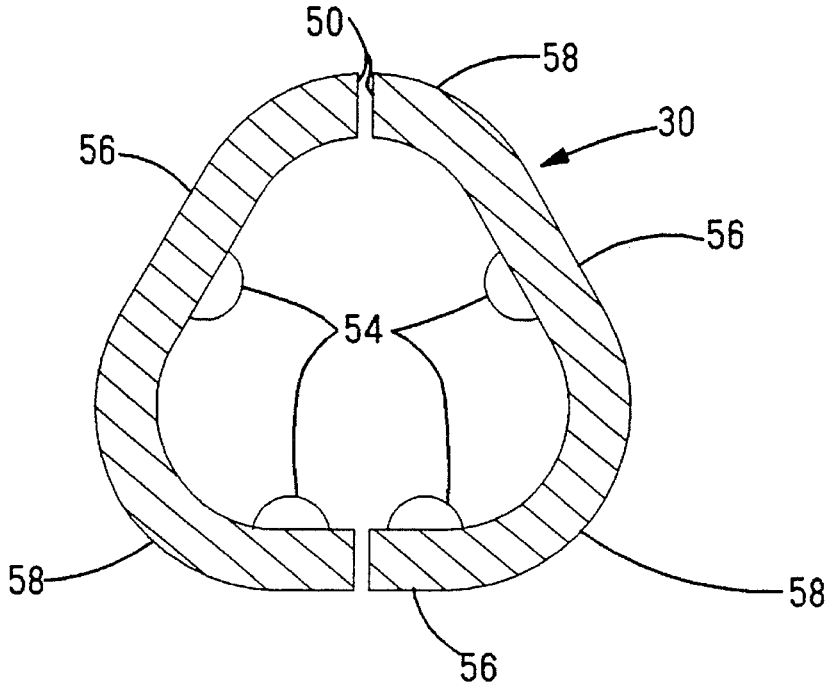
FIG. 3 is a cross sectional view of the socket of FIG. 2 in which the section is taken along section lines 3—3 through the contact dimples formed on the interior on the terminal mating section.
Figure 4:
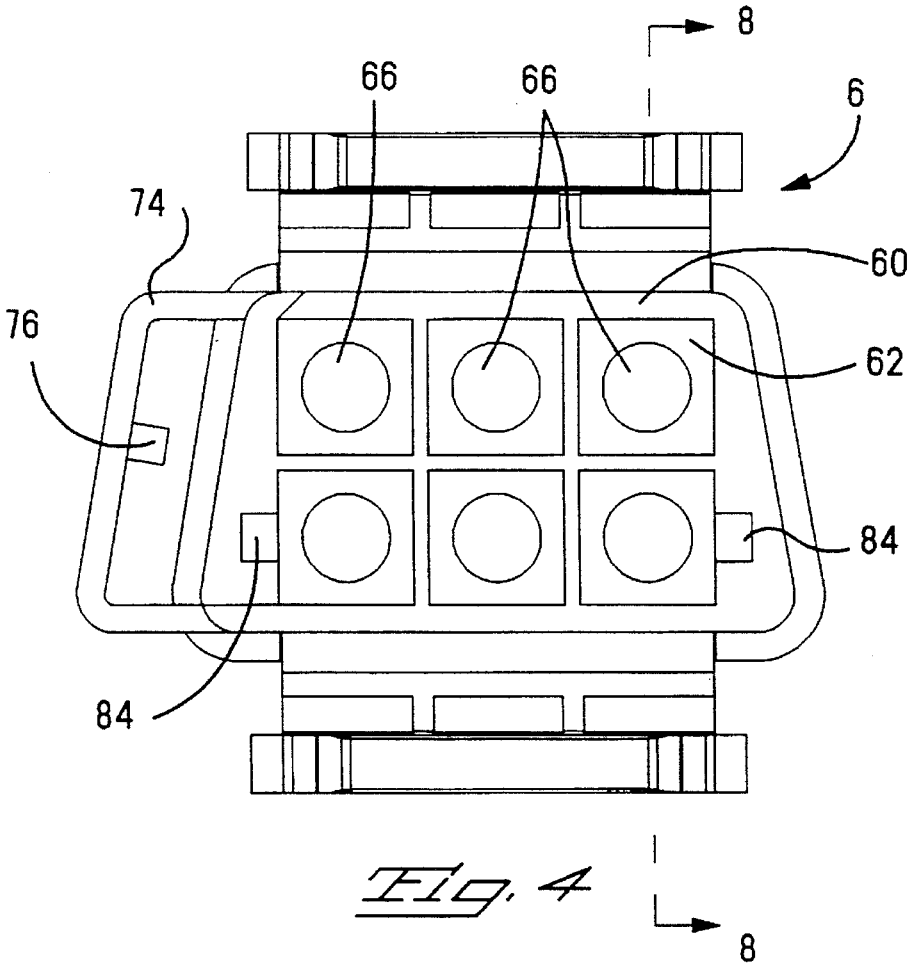
FIG. 4 is a front view of the cap housing.
Figure 5:
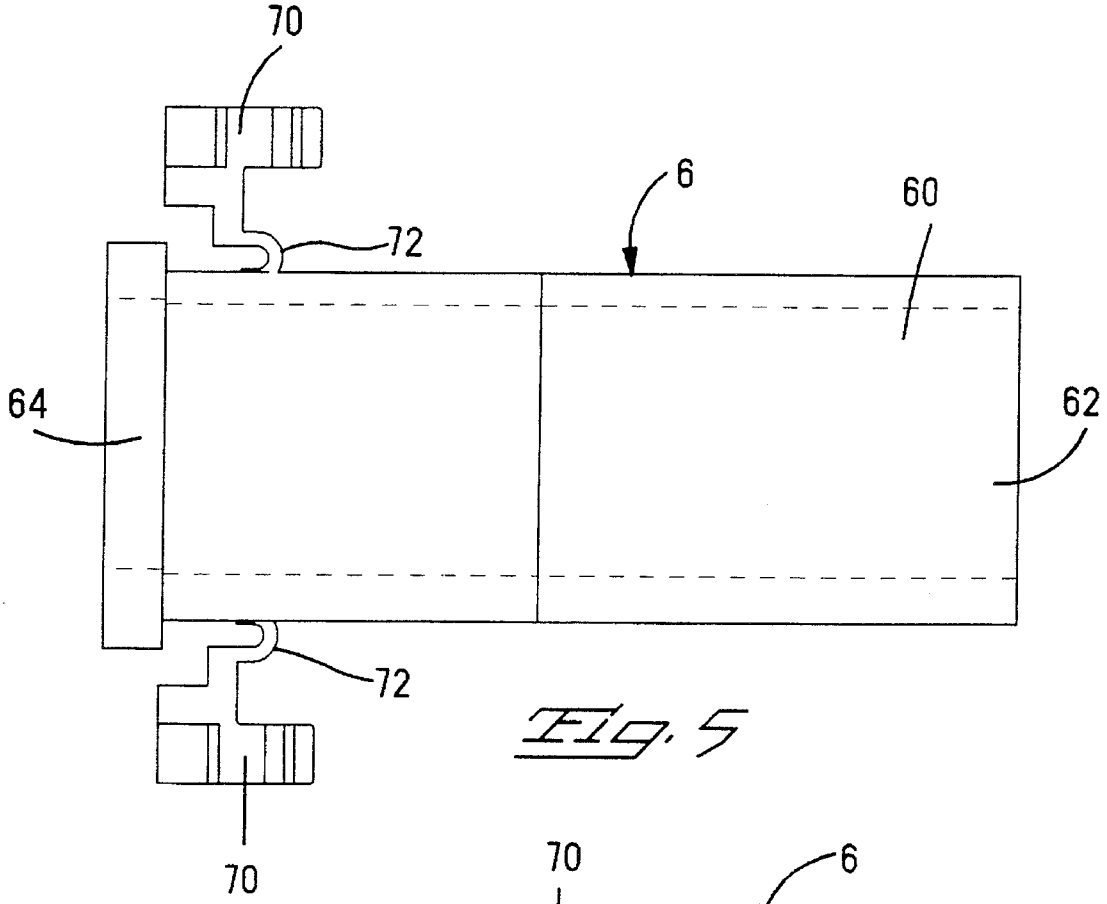
FIG. 5 is a side view of the cap housing.
Figure 6:
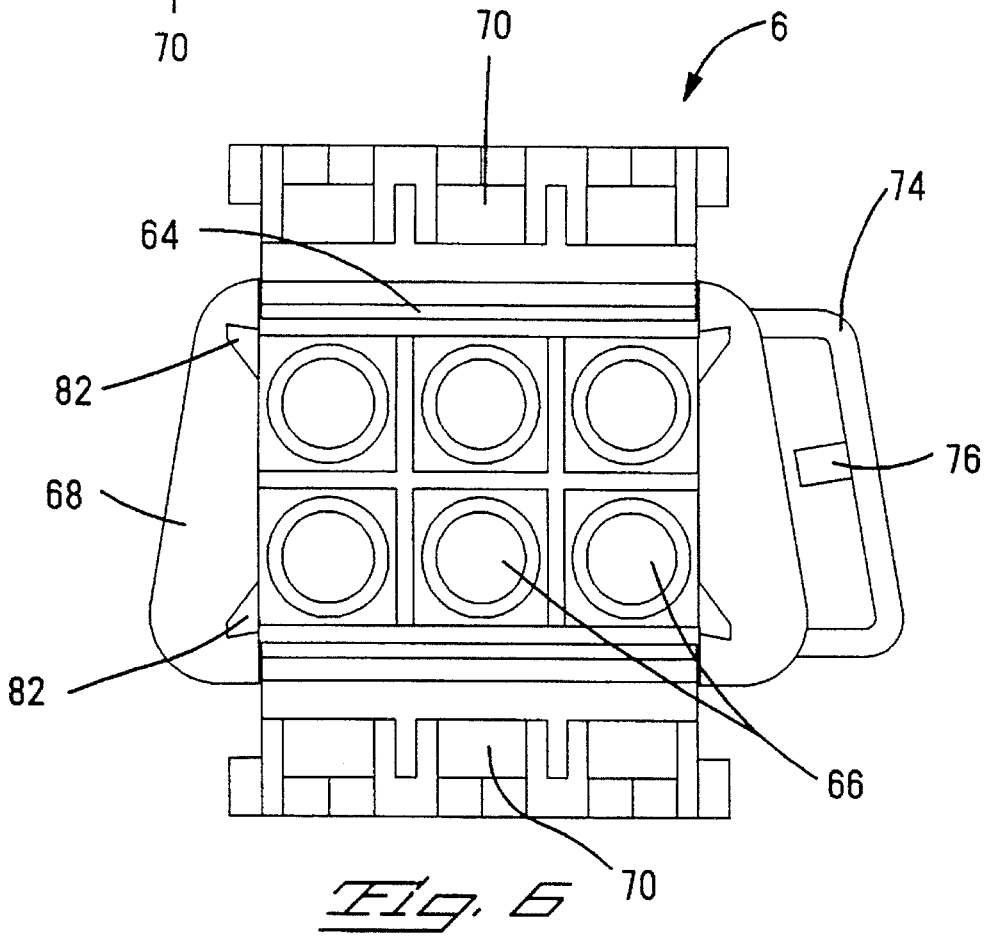
FIG. 6 is a rear view of the cap housing.
Figure 7:
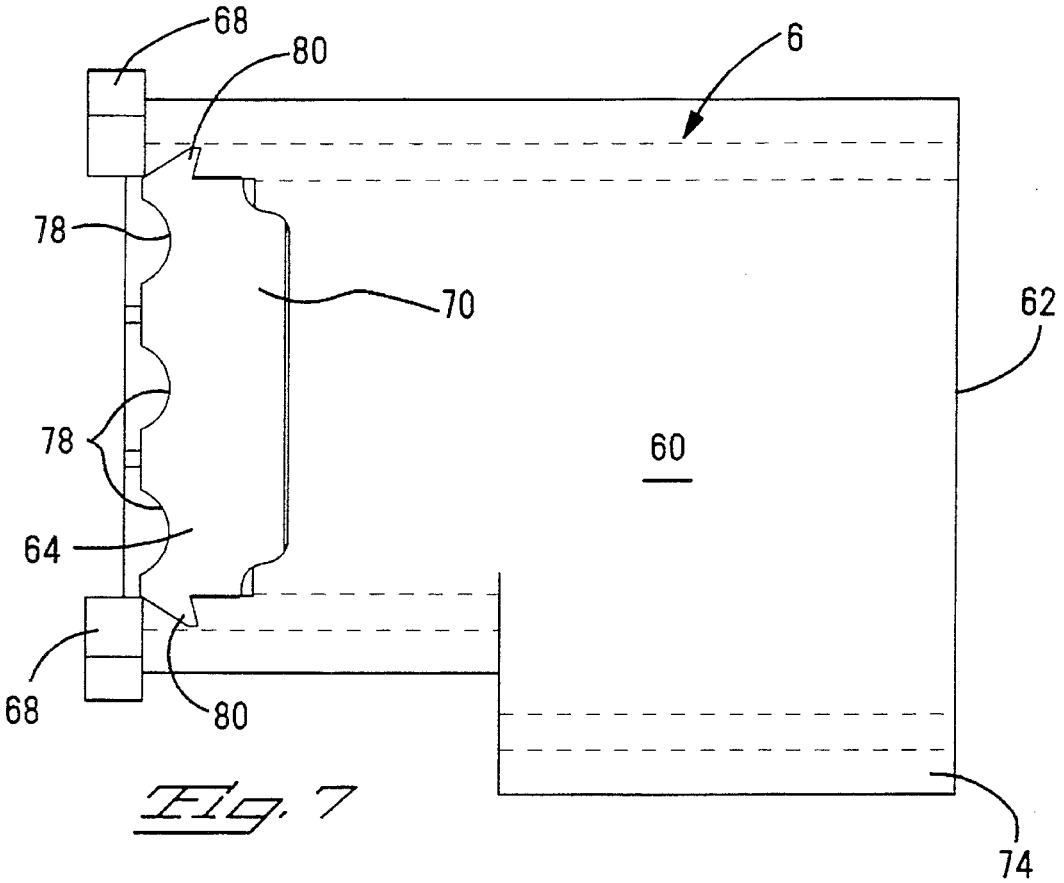
FIG. 7 is a top view of the cap housing.

The socket section 30 is different form a conventional stamped and formed socket having a circular cross section and it functions in a different manner. This socket section has a generally triangular cross section. At one apex of the socket section 30 a slot 50 extends from the forwards end of the terminal rearwardly to a transversely extending stress relief section 52. This slot 50 and the transverse section 52 are formed by stamping out a section of material from the flat blank forming the contact. The edges of the slot 50 do not comprise outer edges of a stamped blank which have been formed into opposing relationship. Edges 54 of the stamped and formed blank are located on the opposite side of the socket section 30 from the slot 50. These edges 54 are formed into opposing relationship and form a seam extending the length of the socket section 30 past the slot 50 and the transverse section 52. Four embossed dimples 54 are located adjacent the front edge of the contact section 30 on the three sides 56 of the generally triangular shaped socket section 30. These embossed dimples are formed upwardly from the flat stock and form rigid inwardly directed protrubrances joined to the flat sides 56 completely around their base. The embossed dimples taper upwardly to a apex which forms precisely located contact points on three sides of the socket section 30. These dimples 54 can be seen in section in FIG. 3. Two of these dimples 54 are located on the sides 56 on opposite sides of slot 50. The other two dimples 54 are on the side 56 containing the seam formed by edges 54. One dimple 54 is located on either side of the seam. Although the socket section has been described as being generally triangular it is apparent that the corners of this triangular section are rounded.

This socket section 30 has four defined contact points formed at each dimple 54. When a cylindrical stamped and formed pin, such as pin 2 is inserted into the socket section 30 of stamped and formed socket 4, these dimples 54 engage the periphery of the cylindrical pin. These contact points are at a precisely located longitudinal point of the socket section 30 and the contact arms defined by the slot 50, the transverse section 52 and the edges 54 have a constant geometry with the contact beam length to the points of contact always being constant. Therefore the contact force and the insertion forces are repeatable and a more reliable contact can be established. Since the male pin must only be inserted to a point where all four dimples are contacting the pin, the depth of insertion of the pin need not be as great as is normally required for a conventional pin and socket termination. The socket terminal 4 can also be used with a solid pin. Also the angular orientation of the pin and the socket is immaterial which means that both the pin 2 and the socket 4 can be inserted into their respective housings in any angular orientation.

The molded soft shell plastic cap housing 6, shown in FIGS. 4–10, has a one piece body 60 molded from a plastic material such as Nylon commonly used with soft shell pin and socket connectors. The cap body 60 has a front side 62 and a rear side 64 with a plurality of cavities 66 extending from the front to the rear. In the preferred embodiment of this invention all of the cavities 66 are substantially identical. The cap housing 6 has an integral flange 68 at the rear end 64 and two integral secondary locks 70 joined to the main cap body by thin flexible web sections 72. A housing latch strap 74 in the form of a thin member joined at both ends to the main housing body 60 is located on one side of the main housing body 60. The outer section of the strap 74 extending generally parallel to the adjacent side of the main housing body has a housing latch barb 76 having a tapered edge and a flat edge to engage a latch arm on a mating housing as will be subsequently discussed. The secondary locks have a plurality of arcuate sections 78 which are configured to fit over the insulation of a wire extending into he rear of the cap housing 6. Clasps 80 on both ends of the secondary locks 70 are dimensioned to engage the recessed sections 82 on the flange 68 at the rear of the main housing body 60. As can be seen from the front view in FIG. 4 and the rear view in FIG. 6, the cap housing 6 and the main body 60 have a generally trapezoidal shape with the bottom of the housing being larger than the top. This shape provides room for two outwardly extending grooves 84 located in the two outermost cavities 66 extending through the main body 60. Although this groove 84 makes the shape of these two cavities slightly different than the other cavities, there are still only two configurations for the cavities. For versions of this connector having a larger number of cavities, this is more significant than for the six cavity connector shown herein. With more cavities, there will still be only two of the cavities which will have the keying grooves 84 so common core pins can be used for molding the additional identical cavities.

Figure 8:
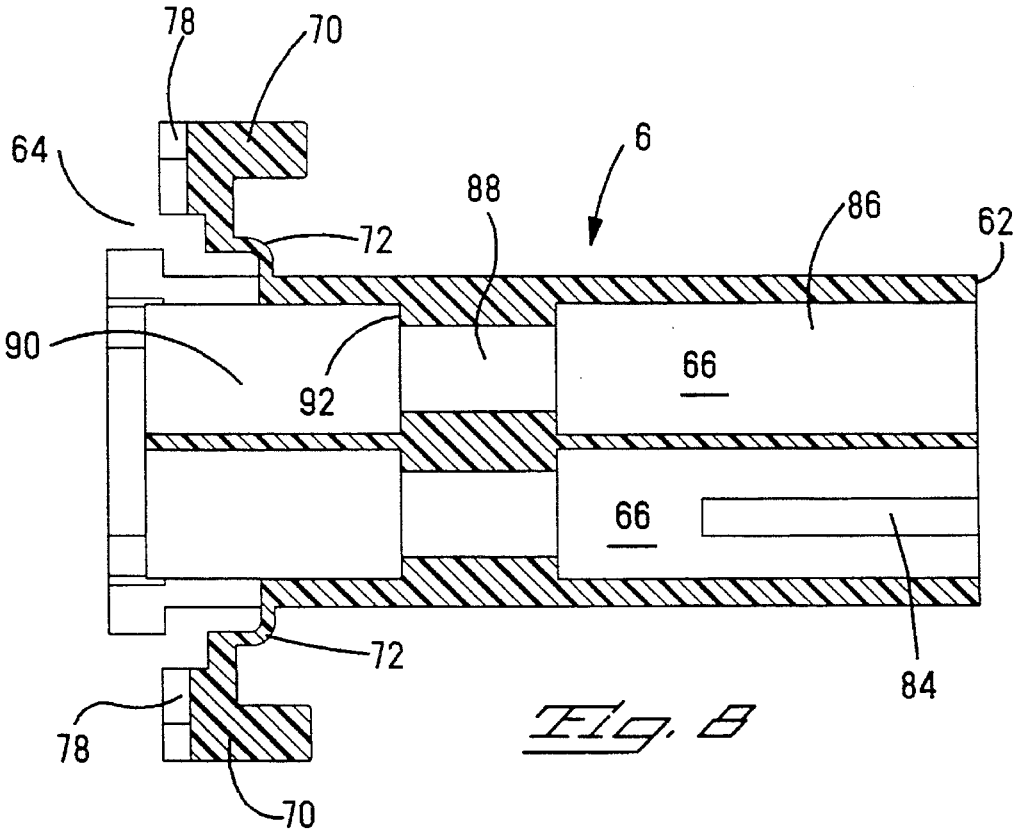
FIG. 8 is a section view taken along section lines 8—8 of FIG. 4.
Figure 9:
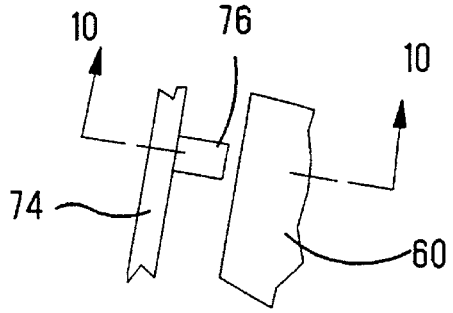
FIG. 9 is a detailed view of the housing latch shown in FIG. 4.
Figure 10:
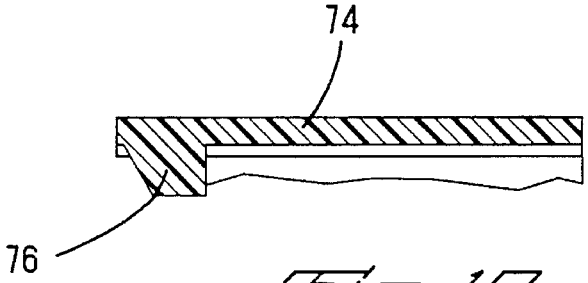
FIG. 10 is a section view of taken along section lines 10—10 in FIG. 9.
Figure 11:
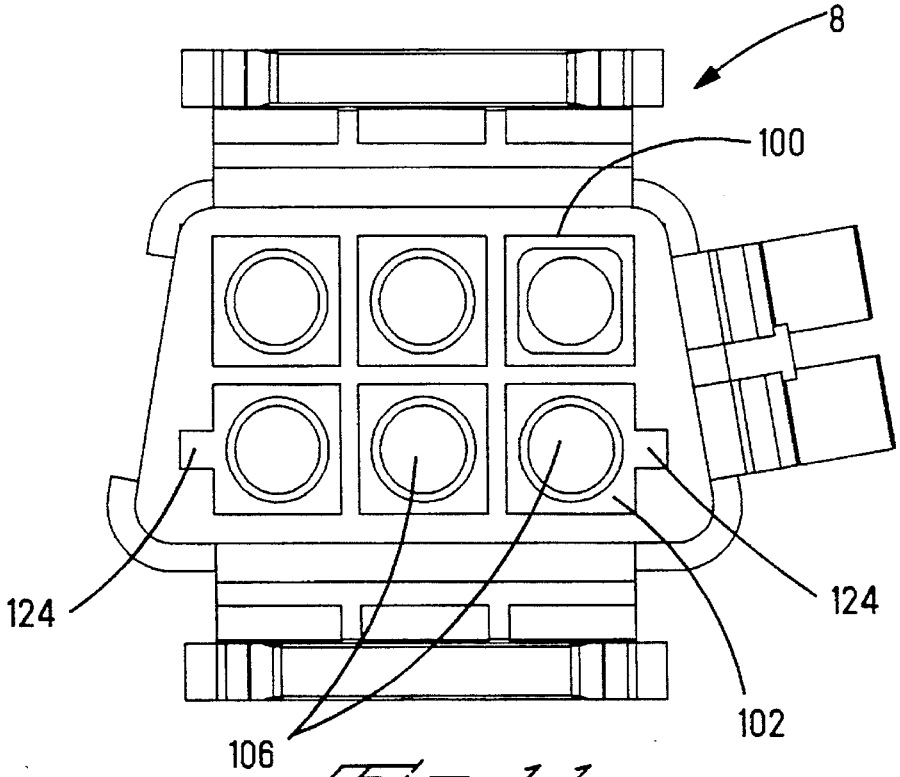
FIG. 11 is a front view of the plug housing.
Figure 12:
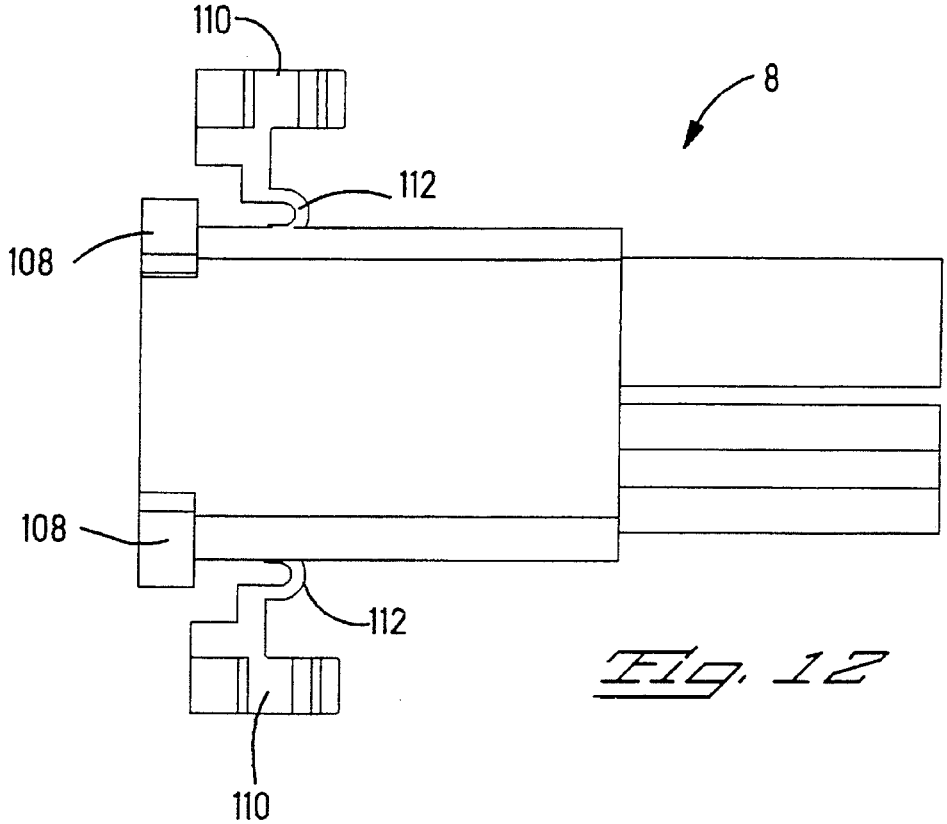
FIG. 12 is a side view of the plug housing.
Figure 13:
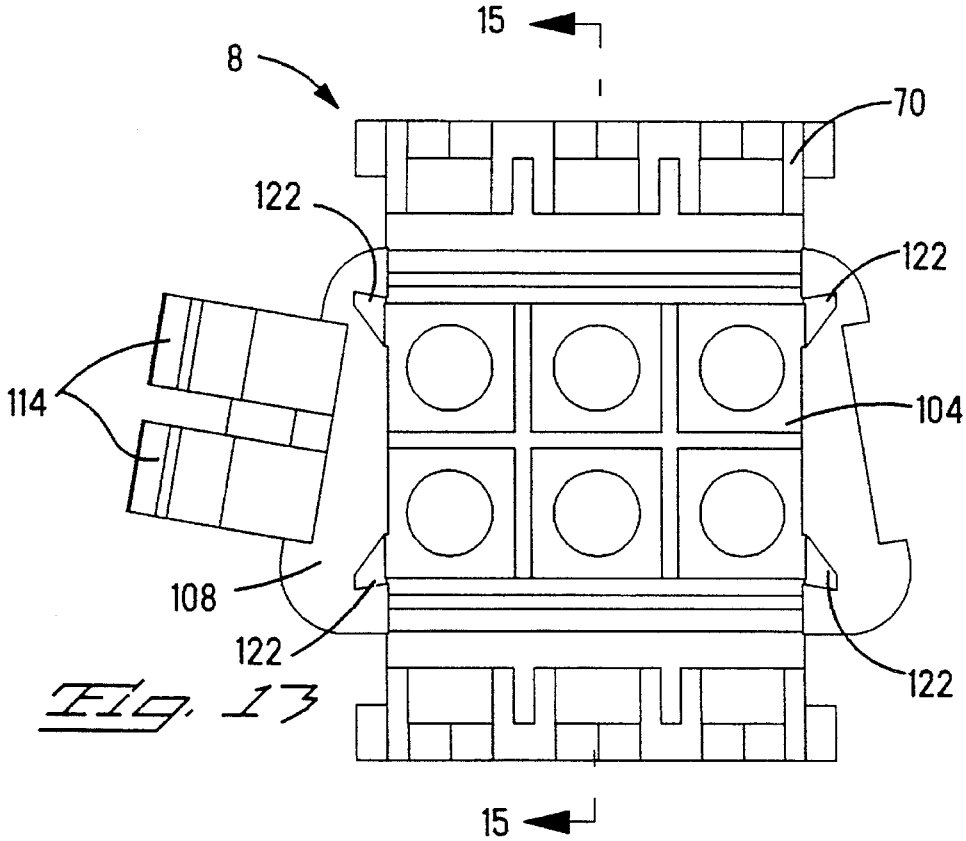
FIG. 13 is a rear view of the plug housing.
Figure 14:
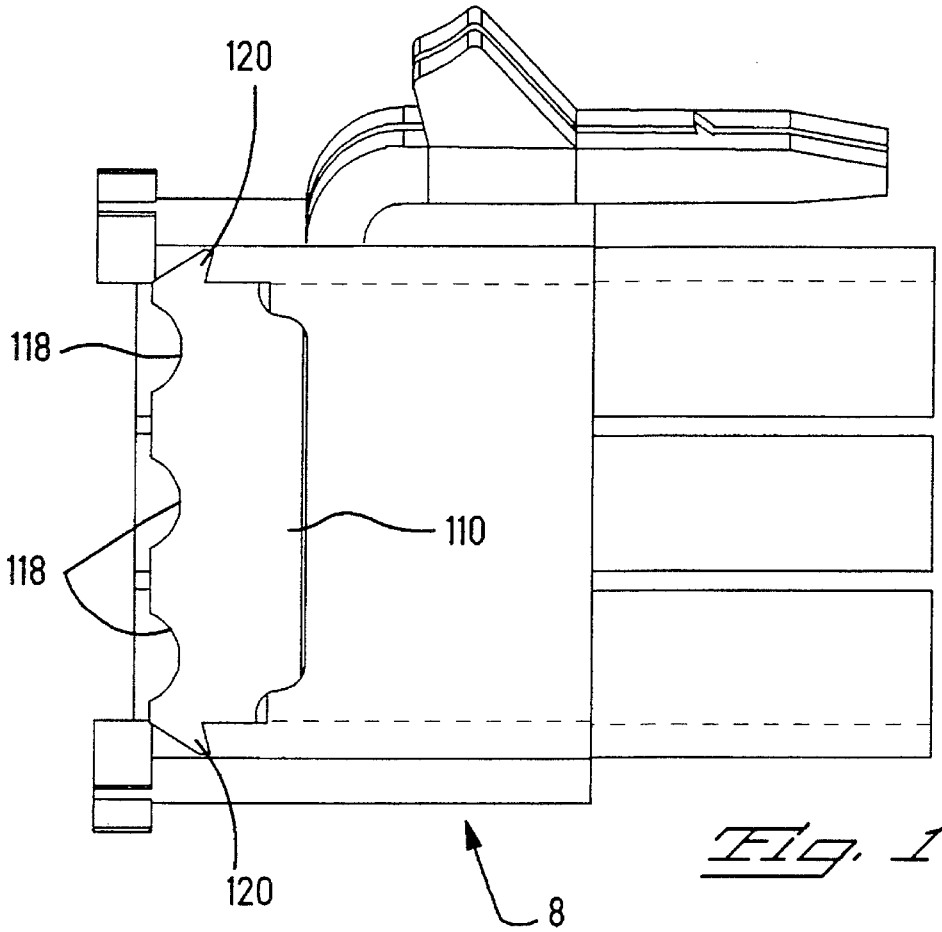
FIG. 14 is a top view of the plug housing.

As can be seen most clearly in FIG. 8 each of the cavities of this connector have three longitudinal sections. The forward section 86 is dimensioned to receive the pin section 10 and the forward portion of the stabilization section 12 of stamped and formed terminal 2. In the center section 88, which has a smaller internal diameter than the other two sections of the cavities 66, the portion of the pin stabilization section 12 to the rear of the two embossed areas 20 and their rear edges 28 will reside when the pin terminal 2 has been fully inserted from the rear. The crimp section 14 will be positioned in the rear cavity section 90 and the shoulder 92 will engage the contact to prevent further travel in a forward direction. The shoulder 94 between the front section 86 and the smaller center section 88 will serve as a bearing section for the retaining ribs formed by the embossed areas 20 with the rear sheared edge 28 engaging shoulder 94 to prevent retraction of the pin terminal 2. When the terminal 2 is inserted into the housing from the rear, the tapered embossed areas 20 will engage the smaller bore of section 88 causing the cylindrical pin stabilization section 12 to be cammed inwardly causing edges 22 to come closer together permitting passage of the embossed areas 20 through cavity section 88. When the stabilization section 12 expands after passage of the embossed areas through section 88, the retention ribs formed by embossed areas 20 will snap out. Since rear edge 28 is a transversely extending sheared edge there will be no camming effect and the contact can no longer be withdrawn from the housing. At this pint the two secondary locks can be folded inwardly with the wires attached to the pin terminals 2 engaging the arcuate sections 78 and with the clasps 80 on the secondary lock snapping into the companion recessed sections 82. The secondary lock will abut the rear edge of the insulation crimp 18. However, since the insulation crimp when formed over into engagement with the wire extends above the outer surface of the wire, the secondary lock cannot be fully close with clasps 80 locking into recessed portions 82 unless the terminals 2 have been fully inserted. The secondary lock 70 thus provides terminal position assurance.

Figure 15:
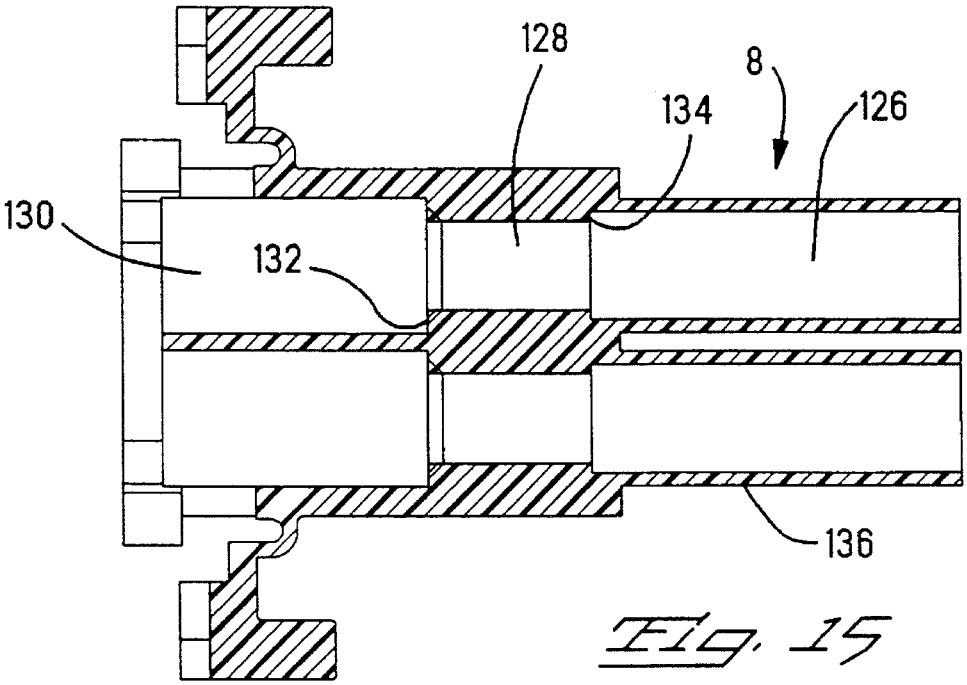
FIG. 15 is a section view of the plug housing taken along section lines 15—15 in FIG. 13.
Figure 16:
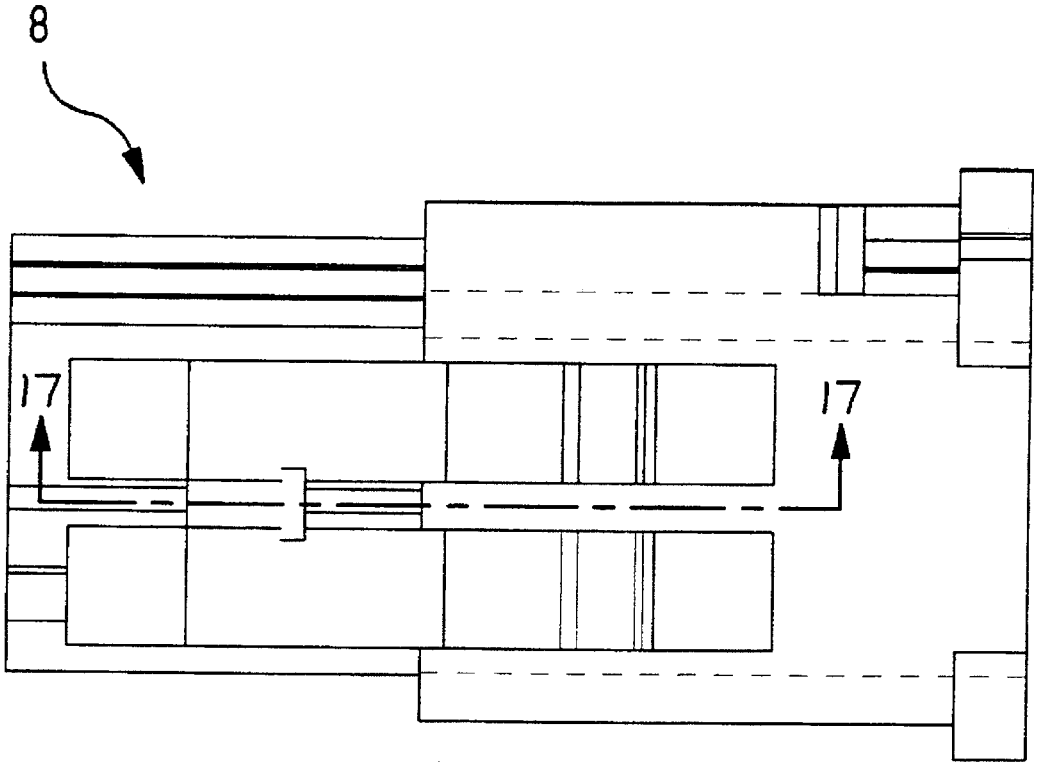
FIG. 16 is a side view of the plug housing showing the side opposite from the side shown in FIG. 12 to show the housing latch.
Figure 17:
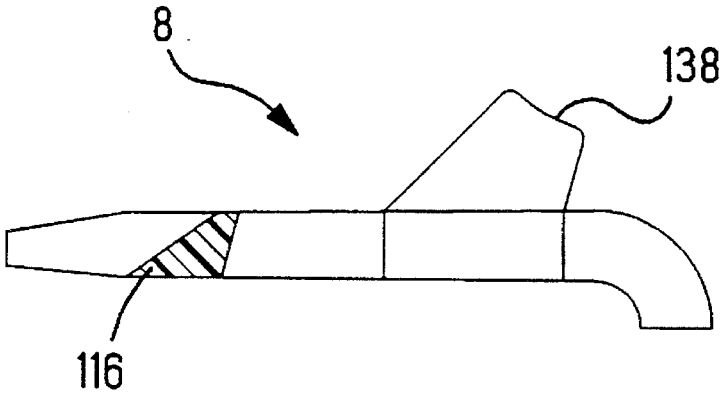
FIG. 17 is a section view taken along section lines 17—17 in FIG. 16 to show the latching feature of the housing latch.

The plug housing 8 is shown in FIGS. 11–17. Socket terminals 4 can be positioned in the plug housing 8 which mates with cap housing 6. The plug housing 8 is also molded of a conventional plastic and includes the same features as the cap housing 6, or in some cases includes companion features which act in concert with corresponding features on the cap housing. The plug housing 6 is a one piece member with a main body 100. The plug body 100 has a front side 1022 and a rear side 104 with a plurality of cavities 106 extending from the front to the rear. In the preferred embodiment of this invention all of the cavities 106 are substantially identical. The plug housing 8 has an integral flange 1088 at the rear end 104 and two integral secondary locks 110 joined to the main plug body by thin flexible web sections 112. Two curved latch arms 114 are joined to one side of the main plug housing body 100. These cantilever arms extend from a base at the rear of the main plug housing body 100 and include a hook section 116 joining the two arms as best shown in FIGS. 16 and 17. These hooks 116 engage the latch barb 76 on strap 74 on the cap housing 6 with the two housings are properly mated. The secondary locks 110 have arcuate sections 118 which are configured to fit over the insulation of a wire extending into the rear of the plug housing 8. Clasps 120 on both ends of the secondary locks 110 are dimensioned to engage the recessed sections 122 on the flange 108 at the rear of the main housing body 100. As can be seen from the front view in FIG. 11 and the rear view in FIG. 12, the plug housing 8 and the main body 100 have a generally trapezoidal shape with the bottom of the housing being larger than the top. This shape provides room for two outwardly extending keys 124 located in the two outermost silos 136 at the front of the main body 100. Although this key 124 makes the shape of these two silos slightly different than the other silos this is a minor modification in the mold.

As can be seen most clearly in FIG. 15 each of the cavities 126 extending through the silos 136 and the rest of the main plug body 100 have three longitudinal sections. The forward section 126 is dimensioned to receive the socket section 30 and the forward portion of the stabilization section 32 of stamped and formed terminal 4. In the center section 128, which has a smaller internal diameter than the other two sections of the cavities 126, the portion of the socket stabilization section 32 to the rear of the two embossed areas 40 and their rear edges 48 will reside when the socket terminal 4 has been fully inserted from the rear. The crimp section 34 will be positioned in the rear cavity section 130 and the shoulder 132 will engage the contact to prevent further travel in a forward direction. The shoulder 134 between the front section 126 and the smaller center section 128 will serve as a bearing section for the retaining ribs formed by the embossed areas 40 with the rear sheared edge 48 engaging shoulder 134 to prevent retraction of the socket terminal 4. When the terminal 4 is inserted into the housing from the rear, the tapered embossed areas 40 will engage the smaller bore of section 128 causing the cylindrical socket stabilization section 32 to be cammed inwardly causing edges 42 to come closer together permitting passage of the embossed areas 40 through cavity section 128. When the stabilization section 32 expands after passage of the embossed areas through section 128, the retention ribs formed by embossed areas 40 will snap out. Since rear edge 48 is a transversely extending sheared edge there will be no camming effect and the contact can no longer be withdrawn from the housing. At this pint the two secondary locks can be folded inwardly with the wires attached to the socket terminals 4 engaging the arcuate sections 118 and with the clasps 120 on the secondary lock snapping into the companion recessed sections 122. The secondary lock will abut the rear edge of the insulation crimp 38. However, since the insulation crimp when formed over into engagement with the wire extends above the outer surface of the wire, the secondary lock cannot be fully close with clasps 120 locking into recessed portions 122 unless the terminals 4 have been fully inserted. The secondary lock 110 thus provides terminal position assurance for the plug housing.

The silos 136 are dimensioned to fit within the forward section 86 of the cap housing 6 with the keys 124 being received within grooves 84 to insure proper orientation. The socket terminals 4 engage the pin terminal 2 with the triangular socket portion providing a controlled mating with the dimples 54 engaging the exterior of the pin sections 10 as previously described. The housing latches 144 include camming grips 138. Inward pressure on the camming grips 138 will disengage the housing latches to permit separation of the mated connectors.

The preferred embodiments of the terminals and connector housings depicted herein are intended merely to comprise one embodiment of the subject matter of this invention and are not intended to be limiting in nature.

We claim:

1. A cylindrical stamped and formed electrical contact terminal having a contact section, a stabilization section and a crimp section, the terminal being insertable from the rear into a cavity in a housing having a forwardly facing internal shoulder in the cavity between a forward cavity section and a smaller cavity section to the rear of the forward section, the stabilization section of the terminal being formed with edges of the stamped and formed stabilization section being opposed and spaced apart to form a gap, the edges being free to resiliently move toward each other to close the gap, the stabilization section having tapered retention ribs on opposite sides of the gap, the ribs being relatively rigid embossed sections tapered toward the rear of the stabilization section and contiguous on three sides with the stabilization section and with a transverse edge located at the rear of the tapered embossed section, the transverse edge engaging the cavity shoulder when the stabilization section is expanded, the tapered retention ribs engaging the housing during movement through the smaller cavity section to inwardly deflect the stabilization section to cause the edges to move toward each other during passage of the stabilization section through the smaller cavity section.

2. The contact terminal of claim 1, wherein the contact section is a pin contact, the pin contact having a generally circular cross section.

3. The contact terminal of claim 2, wherein the contact section is smaller in diameter than the stabilization section.

4. The contact terminal of claim 2, wherein the stabilization section is connected to the contact section by a tapered section.

5. The contact terminal of claim 4, wherein the tapered section extends only partially around the circumference of the contact section.

6. The contact terminal of claim 2, wherein the embossed sections are punched from the stabilization section during the forming process.

7. The contact terminal of claim 2, wherein the crimp section includes a wire crimp section and an insulation crimp section.

8. The contact terminal of claim 1 wherein the contact section is a socket contact.

9. The contact terminal of claim 8, wherein the contact section is smaller in diameter than the stabilization section.

10. The contact terminal of claim 8, wherein the stabilization section is connected to the contact section by a tapered section.

11. The contact terminal of claim 10, wherein the tapered section extends only partially around the circumference of the contact section.

12. The contact terminal of claim 8, wherein the embossed sections are punched from the stabilization section during the forming process.

13. The contact terminal of claim 8, wherein the crimp section includes a wire crimp section and an insulation crimp section.

* * * * *

UNITED STATES PATENT AND TRADEMARK OFFICE

CERTIFICATE OF CORRECTION

PATENT NO. : 5,620,345

DATED : April 15, 1997

INVENTOR(S) : Lawrence Macioce & Peter G. Nielsen

It is certified that error appears in the above-indentified patent and that said Letters Patent is hereby corrected as shown below:

Title page,

Item 73: Assignee: should read:

The Whitaker Corporation, Wilmington, DE

Signed and Sealed this

Twenty-sixth Day of August, 1997

*Attest:*

*Attesting Officer*

Bruce Lehman

BRUCE LEHMAN

*Commissioner of Patents and Trademarks*

UNITED STATES PATENT AND TRADEMARK OFFICE

Certificate

Patent No. 5,620,345 Patented: April 1, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Lawrence Macioce, Peter G. Nielson and Kenneth R. Walker.

Signed and Sealed this Third Day of November, 1998.

BRIAN W. BROWN
*Special Program Examiner*
Technology Center 2800
Physics, Optics, Systems Components
and Electrical Engineering